US005201569A

United States Patent [19]

Jürgen

[11] Patent Number: 5,201,569

[45] Date of Patent: Apr. 13, 1993

[54] MOUNTING FOR RECEIVING A MINING PICK BIT

[76] Inventor: Jädke Jürgen, Hölterbusch 8, 4320 Hattingen, Fed. Rep. of Germany

[21] Appl. No.: 841,014

[22] Filed: Feb. 25, 1992

[30] Foreign Application Priority Data

Mar. 6, 1991 [DE] Fed. Rep. of Germany ..... 9102668

[51] Int. Cl.[5] ..... E21C 35/18

[52] U.S. Cl. ..... 299/86; 299/91

[58] Field of Search ..... 299/86, 91, 92

[56] References Cited

U.S. PATENT DOCUMENTS

| | | | |
|---|---|---|---|
| 3,397,013 | 8/1968 | Krekeler | 299/86 |
| 3,652,130 | 3/1972 | Elders | 299/86 |
| 3,833,264 | 9/1992 | Elders | 299/86 |

FOREIGN PATENT DOCUMENTS

| | | | |
|---|---|---|---|
| 3401243A1 | 1/1984 | Fed. Rep. of Germany . | |
| 1483463 | 6/1992 | France . | |
| 712495 | 1/1980 | U.S.S.R. | 299/86 |
| 1461907 | 2/1989 | U.S.S.R. | 299/86 |

*Primary Examiner*—David J. Bagnell

*Attorney, Agent, or Firm*—Banner, Birch, McKie & Beckett

[57] ABSTRACT

The invention concerns a housing for receiving a mining pick bit in which the free spaces for taking up spoil between the housing and the shaft of the bit are provided into the housing. In this way a fully round shaft can be used, which rotates more easier than a pick bit the shaft of which has a triangular cross-sectional form. Protrusions between the free spaces are made of carbide so that there is a very good wear resistance.

8 Claims, 1 Drawing Sheet

Fig. 1
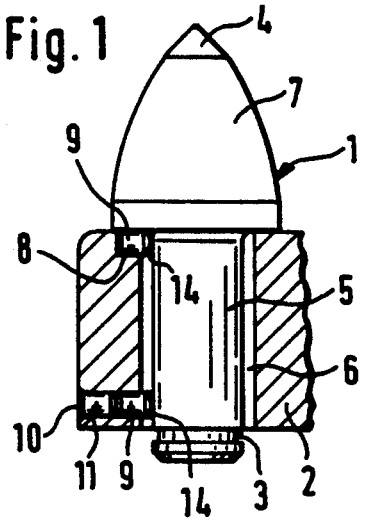
Fig. 2
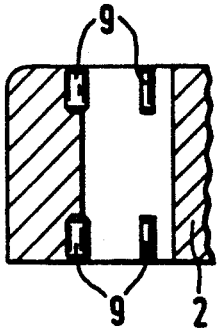
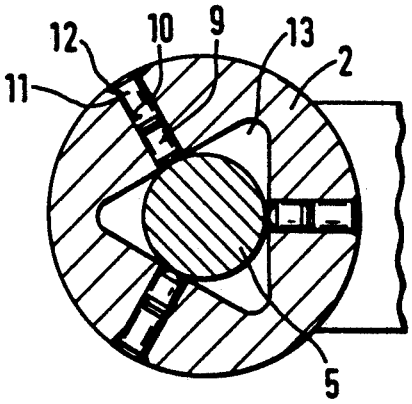
Fig. 3
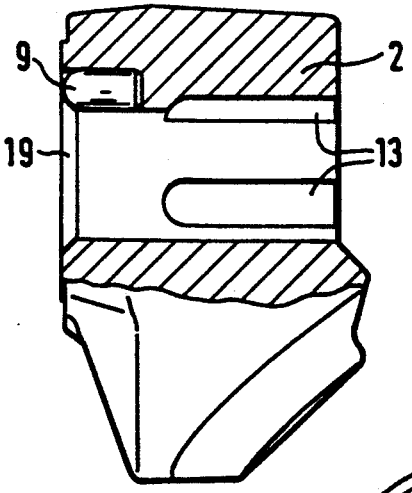
Fig. 4
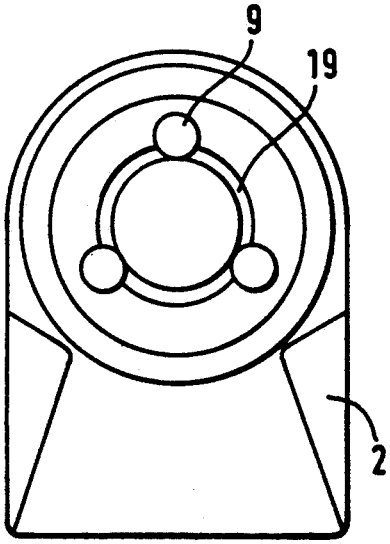
Fig. 5
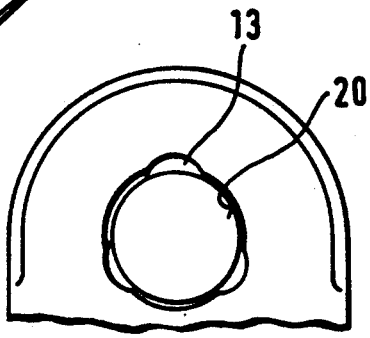
Fig. 6

MOUNTING FOR RECEIVING A MINING PICK BIT

The invention concerns a mounting for receiving a pick bit for mining rock, stone and minerals, especially coal, iron, salt and limestone. The matching pick bit has a carbide head and a shaft which is secured after being inserted into the mounting and which is freely rotatable within the mounting. Between the shaft and the mounting there are, at least in sections, free spaces for the removal of spoil which has entered between the head and the mounting.

A corresponding mounting or housing is known for instance from the German patent specification No. P3401243. It is used in large numbers on a number of big drilling and mining equipment, for instance on cutters, drill heads and other cutting equipment, and even on street cutting rollers. The sockets in the shape of housings, bushes or rotary sleeves are held at a slight inclination to the mining movement resulting in rotation of the pick bit due to the eccentric cutting force attack. This leads to a permanent turning of the pick bit within the housing during the mining or cutting operation and consequently to an even wear of the pick bit. Even if the mounting is a rotary sleeve the rotation of the pick bit within the sleeve can be important, because the rotation of the sleeve may be blocked by the ingress of spoil. After a full wear the pick bit is pulled head-on out of the housing and replaced by a fresh pick bit.

Despite the repeated high compression force between the underside of the head, protruding over the shaft, and the end face of the housing, spoil enters through the gap between these two parts and is then pressed into the interior of the housing. The free spaces formed in the shaft of the bit guarantee that no jamming can take place, but the relatively sharp edged protrusions of the shaft provide a permanent and automatic cleaning. A blockage of the pick bit due to the ingress of spoil has no longer been observed after creating the free spaces.

The wall of the housing is generally very hard, for instance of 50 HRC, either by direct hardening or by inserting a bushing. The permanent grinding of the edges of the bit shaft having in general a triangular cross-sectional shape in connection with the high pressing forces causes however a relatively fast wear of the housing shape into an oval by a progression of the material removal under working loads. However, it has been found that the pick bit tends to stop turning if the housing is slightly enlarged, because the triangular shape causes an out of true running including the danger of a sudden jamming. In such a case the pick bit wears on one side only so that the wear volume of the head cannot be totally used.

It is the object of the invention to improve a housing of the initially described kind in such a way that the worn pick bits have a lower tendency to jam even after a certain wear of the housing. Further, the wear of the housing in its entirety shall be lowered according to a further object of the invention.

According to the invention, in a housing for receiving a mining pick bit having a head and a fully round shaft which is to be secured within the housing, the housing then providing free spaces between the shaft and the housing for conveying out spoil mining material which has entered between the bit and the housing; the housing is provided at one or both ends, or from end to end, with at least two protrusions for guiding the bit shaft at equally spaced positions around the shaft. The protrusions may be incipient protrusions which become proud in use owing to early wear of neighbouring softer housing material.

Compared to the known housings, the free spaces are provided not by shaping the bit shaft, but around a fully round shaft. It is not important whether or not the free spaces are separated from each other, which is the case in the known triangular shafted bits. Thus, the free spaces can be formed by providing the individual protrusions as inserts which protrude inwards from the interior housing wall and which leave an otherwise free cylindrical annular shaped space for collection and conveyance of the mining spoil which has entered the housing. Further, beside the inserts or other protrusions there can be additional pockets formed in the housing in order to create even more space for receiving mining spoil. The respective free space need not extend over the total length of the shaft.

The housing according to the invention, which may be a socket, a bushing or a rotary sleeve which might become jammed for apparent reasons, always carries a pick bit which has a fully round shaft. Even if the seating for the pick bit is enlarged owing to wear there is no danger that the bit will stop turning. Even if the shaft itself is strongly worn owing to long use and the continual rotation, and thus even if the shaft is thinner than it was originally, it keeps its rotational symmetrical shape so that the tendency to jam is reduced. For preventing an enlargement of the housing it is therefore preferable to make the shaft of the pick bit not as hard as the housing. In this way the wear is greater on the bit which must in any case be regularly replaced owing to the wear of its working head. For further improving the stability of the housing the invention proposes that at least the protrusions arranged at the upper end (i.e. the end adjacent which the bit head will be located) of the housing are made from carbide, or are formed including carbide. The faster wearing pick bit is thus less able to enlarge the housing so that the number of bits usable within one housing, before a general overhaul is necessary, can be increased by using carbide within the housing. The housing which is normally welded in place can be used for longer periods by using the admittedly expensive carbide. Only during a general overhaul of the whole tool, i.e. during the replacement of the housing, is the carbide thrown away or recycled. The extra costs caused by the carbide are more than compensated by the better longevity of the tool in its entirety.

It is especially preferable if each protrusion consists of a carbide bolt or each protrusion contains a carbide bolt which is jammed, soldered/ brazed, or otherwise secured in place within a cavity in the housing wall. Each carbide bolt may be arranged with its axis parallel to the axis of the housing or radially within the housing in a corresponding bore where it is secured. Alternatively, there can be strips along the whole length of the housing, or along a section of its length, which are carbide covered. Especially, so called cutting blades for turning tools can be used.

It has already initially been mentioned that the underside of the pick head is pressed onto the upper end face or the housing, owing to the mining pressure, by a considerable force. Also at this place there is a remarkable wear, because mining material, despite the high pressure, repeatedly finds its way into this gap and has an abrasive effect. According to a development of the invention each carbide bolt at the upper end of the housing may extend up to the upper end face of the housing or even protrude from that face so that the underside of the bit head lies in contact with the carbide in the area of the end face during operation. This also leads to a reduced wear of the housing, and may cause a more intensified wear at the underside of the bit head. This wear is however unimportant in view of the considerable residual wear of the bit head. In order to mitigate the danger of a fracture between the bit head and shaft there is a relative big radius at this place of transition. When the carbide protection is effective not only in the radial direction, but also in the axial direction, at the upper end of the housing here a similar rounding must be present, which accommodates the radius between the head and the shaft.

Hereinafter embodiments of the invention which are shown in the drawings, are explained in greater detail. In the drawings:

FIG. 1 a cross-sectional view through a housing with an inserted pick bit without axial retention, FIG. 2 a cross-sectional view similar to FIG. 1 without a pick bit in a modified form, FIG. 3 a cross-sectional view through a housing according to a third embodiment, and FIGS. 4, 5 and 6 are a cross-sectional view and two-end elevations of a further embodiment comprising carbide bolts and pockets.

The embodiment represented in FIG. 1 shows a pick bit 1 which is inserted shaft first into a housing 2. At the free end of the shaft 5 there is a groove 3 with the aid of which the pick is axially secured by a device which is not shown. Substantially, a washer and a circlip is sufficient. The frontal end of the bit head 7 is provided with a carbide tip 4 in order to reduce the wear of the pick bit 1.

At the upper and lower ends of the housing 2 there are carbide bolts 9 arranged radially for forming a three point guide, the three carbide bolts 9 being arranged evenly around the circumference at each end. The carbide bolts at the upper end are brazed into pockets 8 while the carbide bolts 9 at the lower end are inserted into radial bores and secured by plugs 11 which are glued, brazed, soldered or welded into place. All the carbide bolts 9 protrude so far from the interior wall of the housing 2, that there is a free space 6 which has, With the exception of the carbide bolts, the shape of a cylindrical annular space. It serves for accommodating spoil which has entered between the under side of the head 7 and the upper end face of the housing 2. The spoil can leave the housing at the lower end in the area of the groove 3. The free space 6 guarantees that a jamming of the rotary movement of the pick bit 1 within the housing 2 is certainly prevented.

It is clearly seen that the underside of the head 7 lies against the cylindrical surface of the carbide bolt 9 at the upper end of the housing 2. At this place there is thus also a wear protection in the form of the carbide bolts 9. Of course, the transition from the front surface to the contact surface on the shaft 5 is rounded in correspondence to the rounding of the pick bit 1. Otherwise, all areas facing away from the head 7 of all carbide bolts 9 are slightly tapered in order to facilitate removal if the carbide bolts 9 have worked themselves into the shaft 5. In FIG. 1 chamfers 14 are clearly visible.

The embodiment represented in FIG. 2 is so far similar to the one represented in FIG. 1 as both ends of the housing 2 have carbide bolts 9 received in pockets in the form of semi-bores. However, the axes of the carbide bolts 9 run parallel to the axis of the housing 2. Again, there are corresponding roundings for matching the radius of the pick bit (upper end) for an easier removal. Also in this embodiment there are three carbide bolts 9 arranged at each end, evenly distributed around the circumference. The free space 6 is again created by a protrusion of the individual carbide bolts from the wall of the housing 2.

In the embodiment according to FIG. 3 the free spaces are created by pockets 13 so that the basic shape of the interior of the housing 2 is not cylindrical as with the previously described embodiments but has the shape of a polygon. In this embodiment there is a triangular shape with rounded corners. The cross sectional plane corresponds to that of FIG. 1 when the section is taken through the lower carbide bolts 9.

Again, into bores 10 at the upper and lower ends carbide bolts are inserted which are secured by plugs 11 and by brazing 12. Thus there is the same installation as at the lower end of the embodiment according to FIG. 1. However, the individual carbide bolts 9 do not protrude substantially from the housing wall of the housing 2 but lie substantially flush. There is again a three point support, whereby the upper, not shown, end can be carried out in the same way or in the way shown for the embodiment according to FIG. 1. The carbide bolts lying flush with the housing wall may of course be arranged with their axes parallel to the axis of the housing, either at both ends or only at one end.

It is clearly seen that the shaft 5 of the pick bit is definitely supported and that there are sufficient free spaces in the form of the pockets 13 in order to receive spoil, which has entered the shaft support, and in order to convey it through the housing. A very tight fit of the shaft is not important. The housing 2 will be fitted with a fresh shaft pick bit I if the support becomes rather worn, thus avoiding renewal of the housing which requires a considerable amount of work and leads to a rather long period of interrupted operation.

In FIGS. 4, 5 and 6 a further housing 2 is shown in which the corresponding pick bit 1 (not shown) is directly inserted, in which thus no sleeve or bushing is used. Similar to the embodiment according to FIG. 2 there is, at the upper end of the housing which points to the left in FIG. 4, an arrangement of three carbide bolts 9 only one of which is visible in FIG. 4. The other two are angularly spaced at 120° as clearly visible in FIG. 5. Each carbide bolt 9 lies flush not only with the frontal side but also with the surface of the bore so that the head 7 of the pick bit 1 (compare FIG. 1) and the shaft 5 run on carbide surface at the upper end of the housing 2. The surrounding basic material is so soft that after several revolutions of the shaft 5 only the carbide bolts 9 make any contact while the surrounding material is slightly worn down. In the direction of the axes of the carbide bolts 9 a pocket 13 is cut into the lower end of the housing 2 which faces to the right in FIG. 4. The pockets 13 provide a free space for spoil which has worked its way into the bore of the housing 2 along the contact surface between the head 7 and the the upper end of the housing. The mining material which has entered the pockets 13 can freely exit the housing so that no clogging-up can occur.

In FIGS. 5 and 6, which show the front side of the upper and lower ends respectively of the housing 2, it is clearly seen that along a line along the bore there is, at the upper end, a support by a carbide bolt 9 while at the lower end there is a pocket 13, in other words here the support is lacking. This arrangement is deliberately chosen. Under a momentary load onto the pick bit i (FIG. 1), the shaft lies for instance against the carbide bolt 9 at the upper end which carries a reference numeral in FIG. 5. Due to the moment acting onto the shaft pick 1 the protrusion 20 which is provided with a reference numeral in FIG. 6 is loaded at the lower end of the housing. In this way an optimum support of the pick bit 1 is obtained, namely by the carbide bolt 9 on the one hand and by the protrusion 20 on the other hand which is formed in the housing bore.

At the beginning of use of a housing 2 there is a linear contact between the shaft 5 of the pick bit 1 and each carbide bolt 9 which turns into a surface contact rather quickly owing to the material removal. The transition from a linear contact to a surface contact is accompanied by a rather rapid growth of the play between both parts. It is therefore preferable to machine all carbide bolts 9 after a final installation for instance by brazing in, with the aid of a diamond tool up to a bigger diameter than the natural diameter before the machining. Of course, the free space between the protrusions 20 in the embodiment according to FIG. 6 is also machined up. As a result of this machining all carbide surfaces are provided with a radius face which wears much more slowly, because there is a lower specific surface pressure.

In the embodiment according to FIGS. 4 to 6 admittedly each carbide bolt 9 lies flush with the bore or the frontal surface of the housing 2. However, after a very short time of operation the surrounding material is worn down so much that only the carbide bolts support the shaft, not only along the frontal side but also along the top of the bore. The spoil which has progressed into these areas can easily pass on into the pockets 13 and finally out of the housing 2 at the lower end of it. The chamfer 19 at the upper end of the housing 2 serves for receiving the radius surface which is necessary at the transition from the shaft 5 to the head 7 of the pick bit 1 (FIG. 1) in order to avoid the danger of a fracture at this particular area.

I claim:

1. A housing for receiving a mining pick bit having a head and a fully round shaft which is to be secured and rotatable within said housing, wherein said housing is provided at at least one end, with at least two local supports for guiding said bit shaft at equally spaced positions around said shaft whilst providing free spaces between said shaft and an interior wall surface of said housing for conveying out spoil mining material which has entered between said bit and said housing;

wherein at least at the upper end of said housing said supports are made from or include carbide; and wherein each support comprises a carbide bolt which is secured in a cavity in a wall of said housing.

2. A housing according to claim 1, wherein each bolt is orientated with its axis parallel to the axis of said housing.

3. A housing according to claim 1, wherein each bolt is secured into a radial bore within said housing wall.

4. A housing according to claim 1, wherein each bolt protrudes inwardly from said interior wall surface of said housing for forming said free spaces between said shaft and said interior wall surface of said housing.

5. A housing according to claim 1, wherein each bolt at the upper end of said housing is rounded at the side adjacent to said bit head to accommodate a radius between said shaft and underside of said head.

6. A housing according to claim 1, wherein each bolt at the upper end of said housing is flush with or protrudes from an end face of said housing for contacting the underside of said bit head.

7. A housing according to claim 1, wherein said supports at one end of said housing are positioned diametrically opposed to respective ones of said supports at the other end of said housing.

8. A housing according to claim 7, wherein said interior wall surface of the housing is cylindrical and said supports at the upper end of said housing comprise three carbide bolts oriented with their axes parallel to that of said housing and exposed at said interior wall surface; recesses being formed in said interior wall surface at the lower end of said housing in axial alignment with said bolts.

* * * * *